United States Patent [19]

Riffer

[11] 4,046,590

[45] Sept. 6, 1977

[54] PROCESS FOR THE PRODUCTION OF A COLORLESS SUGAR SYRUP FROM CANE MOLASSES

[75] Inventor: Richard Riffer, Berkeley, Calif.

[73] Assignee: California and Hawaiian Sugar Company, San Francisco, Calif.

[21] Appl. No.: 721,197

[22] Filed: Sept. 8, 1976

[51] Int. Cl.[2] ..... C13D 3/14; C13D 3/12; C13J 1/06

[52] U.S. Cl. ..... 127/46 B; 127/46 A; 127/55; 127/56

[58] Field of Search ..... 127/46 A, 46 B, 55, 127/56

[56] References Cited

U.S. PATENT DOCUMENTS

| | | | |
|---|---|---|---|
| 2,568,925 | 9/1951 | Mills | 127/46 A |
| 2,626,878 | 1/1953 | Bartz | 127/46 A X |
| 2,868,677 | 1/1959 | Kopke | 127/46 B |
| 2,937,959 | 5/1960 | Reents | 127/46 B |
| 3,884,714 | 5/1975 | Schneider | 127/46 A X |
| 3,975,205 | 8/1976 | Munir | 127/46 A |

*Primary Examiner*—Sidney Marantz
*Attorney, Agent, or Firm*—Robert G. Slick

[57] ABSTRACT

A process for producing a colorless low-ash, high-purity sugar syrup from cane molasses wherein centrifuged molasses is acidified and treated with an ion exclusion resin. The resin is then eluted with water, and fractions of similar compositions are combined for recycling. The process yields a product similar to refiner's syrup, which is readily further purified by carbon and ion exchange resins to provide a high-quality syrup.

9 Claims, No Drawings

PROCESS FOR THE PRODUCTION OF A COLORLESS SUGAR SYRUP FROM CANE MOLASSES

SUMMARY OF THE INVENTION

Molasses is a by-product of reasonably high sugar content obtained in the manufacture of sugar. Hawaiian molasses typically contains 33% sucrose, 23% water, 16% invert sugar, 16% inorganic constituents, and 12% organic non-sugar substances. Thus total sugars account for about half the weight of cane molasses and are potentially of great economic value. However, because molasses is a residual product from which sugars cannot readily be recovered by crystallization, this highly effective purification technique is not applicable here.

The ion exclusion method had been successfully applied to the recovery of sugar from beet molasses. An ion exchange resin selectively adsorbs the non-ionic sugar molecules, while ionized impurities, both organic and inorganic, and large molecules such as color bodies are selectively excluded. Ionized impurities are rejected by the Donnan equilibrium effect from the highly ionic environment within the resin beads, while large molecules cannot readily penetrate into the beads because of their low mobilities. When the column is eluted with water, large molecules and ionized impurities pass out of the column before the sugars, thus permitting a partial separation. The procedure is readily adaptable to repetition in a cyclic fashion, thus forming the basis for an economical recovery of sugars in which water is a principal regenerant.

The technique is far less successful when applied to cane molasses. The sugar in beet molasses is almost entirely a single component, sucrose, which readily crystallizes from syrups produced by partial purification of the molasses. In contrast, cane molasses contains three principal component sugars—sucrose, fructose, and glucose—each of which strongly inhibits crystallization of the others. Thus after a relatively simple ion exclusion treatment of beet molasses that removes a portion of the impurities, pure sucrose can be obtained as a crystalline product, while the corresponding high-quality product from cane molasses must be a pure syrup. This requires removal of essentially all of the impurities, including a much higher concentration of colorant molecules than is present in beet molasses. Cane molasses is usually darker than beet molasses. The present invention is a method for production of such a colorless high-purity sugar syrup from cane molasses.

A simple method has surprisingly been discovered which strikingly improves the performance of the ion exclusion technique when applied to cane molasses. Without this improvement cane molasses is upgraded by ion exclusion to such a slight degree per cycle or recycle that it is not economical to produce a high quality syrup via this route. The invention dramatically enhances the ion exclusion separation so that the resulting product is of sufficiently high quality that it can readily be further purified to provide a colorless high-quality sugar syrup. In addition to remarkably improving the efficiency of colorant removal, the present invention significantly improves recovery of sugars, reproducibility of the process, and regularity of cycles.

It was found that lowering the pH of the molasses feed by about 1.5 units from its normal value of about 5.5 results in the improvements described. Although this invention is not predicated on any theory of operation, the enhanced performance is believed to occur via two mechanisms. First, colorants are known to be chiefly highly heterogeneous high molecular weight multi-charged molecules, many of which exhibit low isoelectric points. Colorant solubility is decreased as the component isoelectric points are approached. This sharpens the solubility differences between sugars and colorant molecules, manifested in a broader range in the distribution coefficients which determine ion exclusion behavior of molasses components. Second, hydration of the added acid has a salting-out effect: water molecules tied up by orientation around the ions are unavailable for solubilizing large, complex colorant molecules. In addition, hydration removes water from the resin, where it may be replaced by non-ionic sugars. These hydration effects, however, may be inconsequential in view of the high ash content of feed molasses.

There are undoubtedly secondary effects as well. At low pH not only are electrostatic repulsive forces between color molecules at a minimum, but the number of anionic functional groups is also diminished. This results in a reduced degree of complexing between sugars and colorant molecules, which permits some sugar molecules to "leak through" to the high-ash, high-color waste fractions.

The pH of the molasses is reduced immediately prior to addition to the column, to minimize 5-hydroxymethylfurfural formation (a relatively slow reaction at pH 4.0 in any case). This "shocking" of the feed with acid just before addition to the column also minimizes further inversion of sucrose, if this is desired; but in a relatively low pH process such as this, one cannot hope to avoid a substantial degree of inversion. It should be recognized that such acid treatment would be entirely unacceptable for treatment of beet molasses, which, unlike cane, is normally alkaline; any inversion must be strictly avoided because it represents sugar loss as well as a potential inhibitor to crystallization.

Sulfuric acid was found to be somewhat less effective than hydrochloric acid when an identical number of equivalents was used. Treatment with hydrochloric acid additionally eliminates the danger of precipitation of low solubility sulfates of polyvalent cations in the resin bed. Although potassium sulfate is only about half as soluble as potassium chloride at the process operating temperature, this difference is not believed to play a significant role in the disparity of performance between the two acids, because the mechanism of salt exclusion is based on ionic charge, unlike the case for organic exclusion, where molecular size and solubility are the decisive factors.

Normally the lower the pH, the better the separation, but one should avoid using excessive amounts of acid so that side reactions that result in sugar degradation and generation of new color can be minimized. In addition, it should be borne in mind that molasses is a heavily buffered substance, so that lowering the pH more than is necessry could be a costly error, damaging to the economic feasibility of the process. A pH of about 4 has been found to be suitable.

The ion exclusion product obtained by means of the present invention is free of about 90% of the initial molasses color and about 50% of the original ash. This material is easily purified further to provide a colorless high-quality sugar syrup. Granular carbon is used to remove 90% of the remaining color, and a strongly acidic cationic resin such as Rohm and Haas's IR-252 in the hydrogen form is used to remove remaining cations.

Residual color and anions are removed by a strongly basic anionic resin such as Rohm and Haas's IRA-401S as the hydroxide. If it is desired to minimize inversion, a mixed resin bed consisting of a weakly acidic cationic resin such as Rohm and Haas's IRC-50 and a strongly basic anion resin would be substituted for these separate resin treatments. Well over 90% of the molasses sugars is recovered in the low-ash colorless product.

The ion exclusion column may be of any convenient size and diameter to height ratio; but uniform distribution of the molasses onto the resin bed is crucial to the successful operation of the invention, and this distribution becomes more critical as the diameter to height ratio is increased. Materials and construction of the column may follow the usual practice. It was found convenient to operate two such columns, for reasons to be discussed below. In preparation for treatment the molasses is diluted with water to 70° Bx and processed at 80° C in a centrifuge such as Westfalia type SA-7-06-076 separator to remove insoluble solids.

The ion exclusion resin may be a gel-type strongly acidic cationic resin cross-linked with 4% divinylbenzene, such as Dowex 50W-X4 or Rohm and Haas's XE-200; a satisfactory particle size is 50/100 mesh. The resin is used in the monovalent salt form, and for economic reasons one may begin with and regenerate into the sodium form. The principal monovalent cation in cane molasses is potassium, which gradually replaces the sodium in the resin, thus affording a common ion for successful operation of the process.

The column is operated at atmospheric pressure and at about 80° C, and the resin is brought to this temperature by rinsing with hot water before processing is begun. The operating temperature is not critical, because the equilibria involved are functions of absolute temperature; thus, moderate departures from 80° represent small differences between fairly large numbers.

Cane molasses is rather high in divalent cations, which are well-known to interfere with efficient operation of ion exclusion. The top portion of the ion exclusion bed was used as a softener rather than using a separate column. Regeneration can be effected with salt, whereas a weakly acidic cationic resin used in a pretreatment would require the use of more costly regenerants, viz. acid and alkali. The hardness of the feed molasses should be determined; this permits one to compute the fraction of ionic sites in the resin that become replaced by divalent cations per volume of molasses introduced. A convenient regeneration point is that at which about 15% of the monovalent cations have been replaced. At this point the resin is regenerated with a few bed volumes of about 10% sodium chloride, followed by thorough rinsing. It was found convenient to use one column for treatment of the raw molasses and a second column for treatment of recycle fractions. Because the latter are far lower in hardness, the second column can be operated many more cycles before regeneration is required. Occasional regeneration with hydrochloric acid is also required in order to eliminate fouling by iron. The resin was found to resist degradation of beads and oxidation of cross-linkages remarkably well, despite the highly impure nature of the feed and the substantial osmotic stresses inherent in the process.

At the beginning of the procedure, about 0.04 bed volume (B.V.) of acidified 80° C molasses is introduced into the column. For acidification, about 15 cc. of concentrated hydrochloric acid should be used per liter of molasses, but this will depend on the buffering capacity of the molasses. The rate of flow out of the column is adjusted to about 0.12 B.V. per hour. As soon as the molasses level reaches the top of the resin bed, about 0.08 B.V. of water is introduced, and the process is repeated in cyclic fashion for continuous operation. If the process is interrupted for any length of time, a bactericide such as formaldehyde should be introduced to sterilize the resin bed, because the dilute residual sugar solutions are highly susceptible to the growth of microorganisms.

The quality of the water used should be assessed to determine how significant its hardness is relative to that of the molasses being treated. If the molasses contains 2–3% alkaline earth cations by weight, a common analysis, it is clearly futile to use distilled or deionized water when untreated water might contain about 0.1% as much hardness as the molasses. At later stages in the purification, however, good quality water becomes increasingly important.

The run-off from the column is monitored for refractive index, color, and conductivity. Color is used as the basis for combining fractions for recycle in the second column. Any convenient Brix may be selected as a starting point for collection; ordinarily 10% is suitable. After the sweetening-on period, the average eluate Brix is about 21°–23°.

The following scheme is a useful one for classifying column eluate. If the color cannot be monitored continuously, it is convenient to collect fractions of about 0.03 B.V. each.

| Fraction | Color, $1000a^*_{420}$ |
|---|---|
| Waste | >204,000 |
| Molasses for recycle | 136,000 - 203,000 |
| Recycle I | 61,000 - 135,000 |
| Recycle II | 25,000 - 60,000 |
| Product | >24,000 |

Fractions of similar color are combined and evaporated to 75° Bx under reduced pressure. These, including "molasses for recycle", are treated in the second ion exclusion column according to the procedure described previously. It is possible to operate the recycle column at slightly higher Brix than the first column because of the somewhat reduced viscosity resulting from removal of divalent cations and some high molecular weight impurities.

Although ash removal is monitored by conductivity, this was found to be a less useful basis for classification of eluate, partly because a smaller fraction of inorganics than of colorants is removed by the exclusion process. Further, if color and conductivity are plotted against volume of eluate collected, it can be seen that the two cycles are somewhat out of phase.

After about two recycles on the average, an ion exclusion product is obtained which, after concentration, is very similar in flavor and composition to a run-off syrup obtained in cane sugar refining known as refiner's syrup. This is a salable product, but if further purification is desired, most of the remaining color can be removed by treatment with granular carbon according to wellknown procedures. This yields a syrup of color about $1000a^*_{420} = 2000$ but which still contains about 8% ash. The remaining cations can be removed to any desired degree by appropriate treatment with a strongly acidic cationic resin in the hydrogen form, according to well-known procedures. Similarly residual color and anions can be removed by a strongly basic anionic resin as the hydroxide. The product obtained in this case is almost entirely inverted, but inversion can be reduced somewhat by substituting a mixed resin bed here, as described previously. The product is a pleasant-tasting low-ash syrup of color $1000a^*_{420}$ about 30–50.

The following non-limiting examples illustrate preferred embodiments of the invention:

EXAMPLE I

A column two inches in diameter was filled with Dowex 50W-X4 resin in the potassium form to a height of 30 inches. Hot water was passed through the bed for about one hour at a flow rate of about 40 cc/min. and the flow rate was then slowed to 3cc/min. About 60 cc of 70° Brix cane molasses was centrifuged, acidified with HCl to pH 4 and heated to 80° C. This was introduced into the column, taking care to avoid further dilution. This was followed by 120 cc of hot water, and the procedure was repeated for six cycles, after which additional water was added to elute material remaining within the column. When the eluate Brix reached 10°, fractions of 45 cc were collected and their colors measured. The distribution of eluate was:

2% Waste
1% Molasses for recycle
97% Recycle I

The molasses for recycle and Recycle I syrup were concentrated to 75° Bx by heating under reduced pressure.

EXAMPLE 2

A second ion exclusion column similar to that described in Example 1 was prepared, and the procedure was repeated, substituting concentrated molasses for recycle (obtained from many repetitions of the procedure described in Example 1) for the molasses. The distribution of eluate was:

3% Waste
97% Recycle I

The Recycle I syrup was concentrated to 75° Bx by heating under reduced pressure.

EXAMPLE 3

The procedure described in Example 2 was repeated, substituting concentrated Recycle I syrup for molasses for recycle. The distribution of eluate was:

3% Waste
27% recovered Recycle I
70% Recycle II

The Recycle syrups were concentrated to 75° Bx by heating under reduced pressure.

EXAMPLE 4

The procedure described in Example 2 was repeated, substituting concentrated Recycle II syrup for molasses for recycle. The distribution of eluate was:

3% Waste
32% recovered Recycle II
65% Ion exclusion product

The Recycle Syrup was concentrated to 75° Bx and the ion exclusion product to 60° Bx, both under diminished pressure. A portion of the ion exclusion product was concentrated to 75° Bx to give a salable product similar to Refiner's syrup.

EXAMPLE 5

To a column two inches in diameter was added 0.55 kg of granular carbon. The carbon was washed with hot water, then 7 l. of 60° Bx ion exclusion syrup prepared in accordance with Example 4 was passed through the column at a flow rate of 6 cc/min. The color was reduced from $1000a^*_{420}$ = 21,910 to 1807.

EXAMPLE 6

A column two inches in diameter was filled with Amberlite IR-120+ resin in the hydrogen form to a height of 30 inches. 3.2 l. of 60° Bx carbon-treated ion exclusion syrup was passed through the resin at a flow rate of 400 cc/min. Metal cations were removed, yielding a low pH syrup of unaltered color.

The column, after rinsing and backwashing, was regenerated with 5 l. of 5% sulfuric acid at a flow rate of 200 cc/min.

EXAMPLE 7

A column two inches in diameter was filled to a height of 30 inches with Amberlite 401S in the hydroxide form. 3.9 l. of 60° Bx syrup prepared in Example 6 was passed through the resin at a flow rate of 400 cc/min. Residual color and anions were removed, yielding a syrup containing 0.1% ash and a color of $1000a^*_{420}$ = 42. This product is very similar to liquid invert solutions on the market.

The column, after rinsing and backwashing, was regenerated with 5 l. of 4% sodium hydroxide at a flow rate of 100 cc/min.

EXAMPLE 8

A column two inches in diameter was filled to a height of 30 inches with a mixture, 2:1 by volume, of Amberlite IRA-401S in the hydroxide form and Amberlite IRC-50 in the hydrogen form. 3.2 l of 60° Bx carbon-treated ion exclusion syrup was passed through the resin at a flow rate of 50 cc/min. Residual ash and color were removed without subjecting the syrup to inversion-catalyzing sulfonic acid groups. The product obtained was similar to that from Example 7, but with a somewhat lower invert content.

After rinsing the column, backwashing was used to achieve a hydraulic separation of the two resins. The 401 S was regenerated with 3.3 l of 4% sodium hydroxide at a flow rate of 70 cc/min. The IRC-50 was regenerated with 4 l of 5% sulfuric acid at a flow rate of 70 cc/min.

I claim:

1. A process for producing a sugar solution from cane molasses comprising the steps of:

a. diluting said molasses with water,
b. heating said molasses,
c. centrifuging said molasses to remove insoluble solids,
d. acidifying said molasses to a pH of about 4,
e. immediately passing said acidified heated molasses through an ion-exclusion resin wherein sugars are adsorbed and impurities are excluded, and
f. passing water over said resin to elute and recover sugar solution from said resin.

2. The process of claim 1 wherein the molasses is diluted to about 70° Bx.

3. The process of claim 1 wherein the molasses is acidified with hydrochloric acid.

4. The process of claim 1, wherein the ion exclusion resin is a strongly acidic cationic resin with about 4% divinylbenzene crosslinkage.

5. The process of claim 1 wherein the ion exclusion separation is carried out at atmospheric pressure and at about 80° C.

6. A process of claim 1 wherein the ion exclusion product, i.e. recovered sugar, is further treated to produce a colorless low-ash sugar syrup, said process comprising the additional steps of:

a. passing the ion exclusion product through a bed of granular carbon, b. passing said product through a strongly acidic cationic resin, then through a strongly basic anionic resin, and c. recovering a colorless, low-ash sugar solution.

7. A process according to claim 6 in which a mixed bed of a weakly acidic cationic resin and a strongly basic anionic resin are substituted for the separate resin treatments.

8. The process of claim 1 wherein the eluted material is monitored for color and divided into fractions in accordance with color and said fractions further processed as follows (all references to color being $1000a^*_{420}$):

>204,000 discarded as waste 25,000 to 203,000 concentrated and recycled

<24,000 concentrated and recovered as final product

9. The process of claim 8 wherein two columns of ion exclusion resin are employed, namely a first column for the treatment of cane molasses and a second column for recycling production from the first column.

* * * * *